United States Patent [19]

Bell et al.

[11] 4,266,674

[45] May 12, 1981

[54] OPTOELECTRONIC DEVICE FOR AUTOMATICALLY INSPECTING A GROUP OF CIGARETTES OR THE LIKE

[75] Inventors: Richard P. Bell; Karl F. Rill, both of Cincinnati; John C. Butler, Centerville, all of Ohio

[73] Assignee: Richard Equipment Company, Inc., Cincinnati, Ohio

[21] Appl. No.: 10,062

[22] Filed: Feb. 7, 1979

[51] Int. Cl.[3] ..... B07C 5/342

[52] U.S. Cl. ..... 209/536; 209/546; 209/936; 250/223 R; 53/54; 53/499

[58] Field of Search ..... 209/535, 536, 546, 587, 209/936; 250/223 R; 356/237; 53/54, 131, 499

[56] References Cited

U.S. PATENT DOCUMENTS

| | | | |
|---|---|---|---|
| 2,922,519 | 1/1960 | Radley | 209/936 X |
| 3,473,037 | 10/1969 | Schmermund | 250/223 R |
| 3,555,287 | 1/1971 | Schmermund | 250/223 R |
| 4,165,277 | 8/1979 | Frewin | 209/526 X |
| 4,170,306 | 10/1979 | Marshall et al. | 209/582 X |

*Primary Examiner*—Joseph J. Rolla
*Attorney, Agent, or Firm*—Wood, Herron & Evans

[57] ABSTRACT

An automatic optoelectronic inspection device is located at a position downstream from a cigarette making machine and upstream from cigarette packaging machinery, and cigarettes are conveyed in groups to the inspection device where each group is inspected. The inspection device includes a plurality of photodetectors arranged so that there is a one-to-one correspondence between the position of a photodetector and the position occupied by each cigarette in a normally formed group. Each photodetector includes a light-emitting source for illuminating the end portion of a cigarette and a photoelectric transducer for sensing light reflected from the end portion of a cigarette in registration with the photodetector. The power to the light-emitting sources is controlled in such a way that the intensity of the light emanating from each light-emitting source is modulated at a high frequency. The signal produced by each photoelectric transducer is AC-coupled to circuitry for comparing each photoelectric transducer signal with a preset threshold signal, thereby substantially eliminating the effects of varying ambient light on the accuracy with which missing and improperly filled cigarettes are detected. If the intensity of reflected light is such that the photoelectric transducer signal is less than the threshold signal, the comparison circuitry indicates that a cigarette is missing from the group or is improperly filled, and the group of cigarettes is rejected. Other features are also disclosed.

21 Claims, 4 Drawing Figures

OPTOELECTRONIC DEVICE FOR AUTOMATICALLY INSPECTING A GROUP OF CIGARETTES OR THE LIKE

BACKGROUND OF THE INVENTION

The present invention relates to methods and apparatus for automatically inspecting machine-made tobacco products, such as cigarettes, cigars or cigarillos, to insure that the content of each subsequently formed package meets production standards. More particularly, the present invention relates to an improved method and apparatus for detecting, for example, that a cigarette is missing from a group or that a cigarette in the group is improperly filled prior to packaging the group.

It is well known to inspect a tobacco product, such as a cigarette, prior to packaging for the purpose of detecting an inadequate or loose charge of tobacco shreds near the end. On the one hand, such an inspection is necessary because an insufficiently or loosely filled cigarette cannot be properly handled by cigarette packaging machinery. Furthermore, such an inspection is desirable from the standpoint that a smoker is annoyed and risks injury if a cigarette is improperly filled. That is, tobacco shreds are likely to fall from the end of the cigarette as the smoker removes the cigarette from the package creating a mess. Furthermore, if the smoker ignites an improperly filled cigarette, a large flame can result which could startle or burn the smoker.

An inspection is also necessary from the standpoint that a subsequently formed package must contain a predetermined number of cigarettes. If a cigarette is missing, the purchaser is cheated.

It is, therefore, desirable to reject cigarettes which cannot be properly handled so as to maintain high speed production. It is also desirable to avoid customer complaints by detecting missing and improperly filled cigarettes so that a defective package is not subsequently formed.

One known technique for detecting missing and improperly filled cigarettes is mechanical inspection. Mechanical inspection employs pins which are pushed against the end portions of cigarettes. The extent to which a pin penetrates indicates the amount of tobacco shreds in the end portion of a cigarette. However, mechanical inspecting is undesirable due to the risk of damage to cigarettes during inspection due to compressing the end portions. Furthermore, decreased production results since the mechanical response time is relatively long which means that inspecting cannot be performed at a speed compatible with the speed of modern cigarette making and packaging machinery.

Another known technique is electrostatic inspection as disclosed in U.S. Pat. Nos. 3,951,267 and 3,993,194. The speed of electrostatic inspection is relatively high. However, the amount of moisture in the tobacco, changes in humidity, temperature and other ambient conditions and the high amount of electrical noise in the vicinity of machinery for making and packaging cigarettes affect the accuracy with which missing and improperly filled cigarettes are detected.

Also known are optical techniques for detecting missing and improperly filled cigarettes. U.S. Pat. No. 3,812,349 discloses an optical inspecting apparatus which includes a laser, an optics system, a photodetector and a comparison circuit to check light reflected from the tobacco in the end portion of a cigarette. However, the disclosed apparatus only checks one cigarette at a time because each cigarette is also inspected for surface flaws. Therefore, the device operates at a slow production speed. Furthermore, the apparatus is expensive due to the cost of the laser.

U.S. Pat. No. 3,473,037 discloses an optical inspecting apparatus which includes a single light source, an optics system and an array of photocells to check light reflected from the tobacco in the end portions of cigarettes in a preformed group. However, the optics system is relatively complicated and expensive. This patent also discloses a photo-imaging system including a vidicon which involves complexity and high cost. Furthermore, U.S. Pat. No. 3,980,567 discloses a fiberoptics inspecting apparatus for illuminating and sensing light reflected from the tobacco in the end portions of cigarettes. However, the disclosed apparatus is relatively expensive due to the cost of the fiber-optics.

One objective of the present invention is to provide a high speed method and apparatus for detecting cigarettes missing from a preformed group and improperly filled cigarettes in the group prior to packaging.

Another objective is to provide a method and apparatus for detecting missing and improperly filled cigarettes with a high degree of accuracy so that normal groups are packaged and only defective groups are rejected.

An additional objective is to minimize the effects of varying ambient conditions on the accuracy with which missing and improperly filled cigarettes are detected.

It is a further objective to provide an improved optical method and apparatus for detecting missing and improperly filled cigarettes which is characterized by high speed and accuracy and at the same time has a relatively low initial cost and is reliable and economical in operation.

SUMMARY OF THE INVENTION

The present invention provides an improved method and apparatus for optically inspecting a preformed group of cigarettes being conveyed to cigarette packaging machinery for the purpose of detecting whether or not there are missing or improperly filled cigarettes. In a preferred embodiment, a plurality of photodetectors equal in number to the number of cigarettes in a normally formed group is located upstream from the cigarette packaging machinery. The preformed group of cigarettes is conveyed to a position at which the end portion of each cigarette in the group is brought into registration with a photodetector.

Each photodetector includes a light-emitting source for illuminating the end portion of a cigarette and a photoelectric transducer for sensing light reflected from the end portion of a cigarette in registration with the photodetector.

A sequencing means is connected to the photodetectors for sequentially controlling the power to the light-emitting sources in such a way that adjacent sources are not modulated simultaneously. Because no two adjacent light-emitting sources are modulated simultaneously, optical coupling between the light-emitting source of one photodetector and the photoelectric transducer of another photodetector is minimized, thereby improving the accuracy with which missing and improperly filled cigarettes are detected.

Each light-emitting source illuminates the registered end portion of a cigarette in the group, and light is reflected from the end portion and sensed by the photoelectric transducer associated with the light-emitting source. Preferably, a biasing signal is applied to each light-emitting source so that each photoelectric transducer operates in a linear range during modulation of the power to the light-emitting source.

The amount of reflected light depends on the presence of a cigarette and the amount of tobacco in the end portion of the cigarette. Each photoelectric transducer produces a signal which is determined by the amount of light reflected from the registered end portion of a cigarette. Each photoelectric transducer signal is compared with a preset threshold signal to determine whether or not a properly filled cigarette is present. Preferably, threshold adjusting circuitry is provided for separately presetting a threshold signal which is to be compared with the signal produced by each photoelectric transducer.

The power to each light-emitting source is modulated at a high frequency. Also, the signal produced by each photoelectric transducer is AC-coupled to the comparison means, thereby substantially eliminating the effects of varying ambient light on the accuracy with which missing and improperly filled cigarettes are detected.

If the reflected light is less than enough for a photoelectric transducer to produce a signal that equals or exceeds the threshold signal, the comparison means produces a reject signal to indicate a missing or improperly filled cigarette. The reject signal can be utilized to energize a reject solenoid to eject the defective group of cigarettes or to energize a display means for indicating whether or not a defective group of cigarettes is present.

The present invention provides a high speed method and apparatus for accurately inspecting a preformed group of cigarettes which is both relatively low in initial cost and economical in operation. The power to the light-emitting sources is controlled so that adjacent sources are not modulated simultaneously. As a result, optical coupling between photodetectors is minimized, thereby improving accuracy. The effects of varying ambient light are substantially eliminated by applying biasing signals to the light-emitting sources so that the photoelectric transducers operate in a linear range and by modulating the sources at a high frequency and AC-coupling the photoelectric transducer signals to the comparison means, thereby further improving accuracy. Advantageously, the optoelectronic inspection device of the present invention may be constructed with readily available, low-cost solid state components and is extremely reliable as well as substantially maintenance-free in operation.

The above and other objectives, features and advantages of the inspection device of the present invention will be better understood in light of the description which is given below in connection with the drawing in which.

Figure 1:
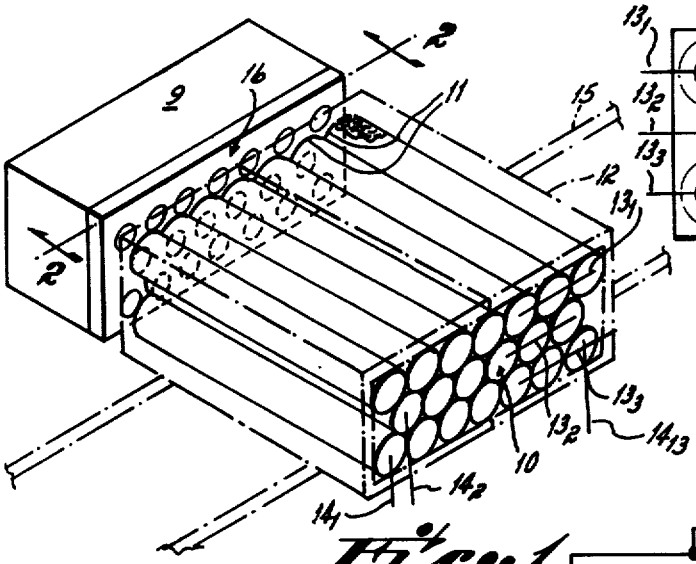
FIG. 1 is a view of an inspection station whereat a preformed group of cigarettes is inspected by the method and apparatus in accordance with the present invention.

FIG. 1 illustrates an inspection device 9 at which a preformed group of cigarettes 10 is inspected to detect whether or not a cigarette is missing from the group or a cigarette in the group has an end portion 11 with an inadequate or loose charge of tobacco shreds. The group 10 normally comprises a predetermined number of individual cigarettes. There may be twenty cigarettes, for example, in a normally formed group.

The group 10 may be formed by loading twenty cigarettes into a cigarette carrier 12 at the discharge end of a cigarette making machine as disclosed, for example, in aforementioned U.S. Pat. No. 3,951,267. As shown in FIG. 1, the cigarettes are loaded into the carrier 12 so as to form three rows $\mathbf{13}_1$, $\mathbf{13}_2$ and $\mathbf{13}_3$ and thirteen columns $\mathbf{14}_1$, $\mathbf{14}_2$, . . . $\mathbf{14}_{13}$.

The carrier 12 is conveyed to the inspection device 9 by a conveying means 15 on the way to cigarette packaging machinery (not shown). At the inspection device, a plurality of photodetectors 16 is located proximate the path along which the carrier 12 is conveyed. The conveying means 15 has a step-like advancement between times during which cigarettes are loaded into carriers 12, as is well known. The photodetectors 16 need only be positioned at a point along the path of the carriers 12 such that each carrier 12 momentarily pauses proximate the photodetectors 16 as the carrier is stepped along by the conveying means 15.

As shown in FIG. 1, when the carrier 12 pauses momentarily in proximity to the photodetectors 16, the photodetectors are disposed near the end portions 11 of the cigarettes in the group 10. The number of photodetectors is selected to equal the number of cigarettes in a normally formed group, and the photodetectors 16 are arranged so that there is a one-to-one correspondence between the position of a photodetector and the position occupied by a cigarette in a normally formed group. Exact registration between a photodetector and a cigarette can be achieved by simply adjusting the location of the inspection device 9 with respect to the position that the carrier 12 momentarily pauses during step-like advancement by the conveying means 15.

Figure 2:
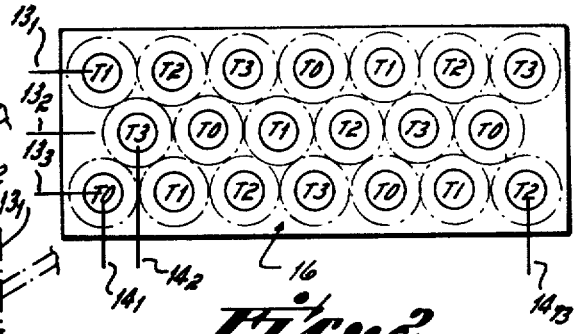
FIG. 2 is a front view of the apparatus in accordance with the present invention taken along line 2—2 in FIG. 1.

As can be seen in FIG. 2, the photodetectors 16 are arranged in rows $\mathbf{13}_1$–$\mathbf{13}_3$ and columns $\mathbf{14}_1$–$\mathbf{14}_{13}$ corresponding to the rows and columns in which the cigarettes in a normally formed group are arranged. Because the photodetectors 16 are in registration with the end portions 11 of the cigarettes in the group 10, light emanating from a photodetector 16 will be reflected from the tobacco charge in the end portion 11 of a cigarette in the group 10 back to the same photodetector.

Figure 3:
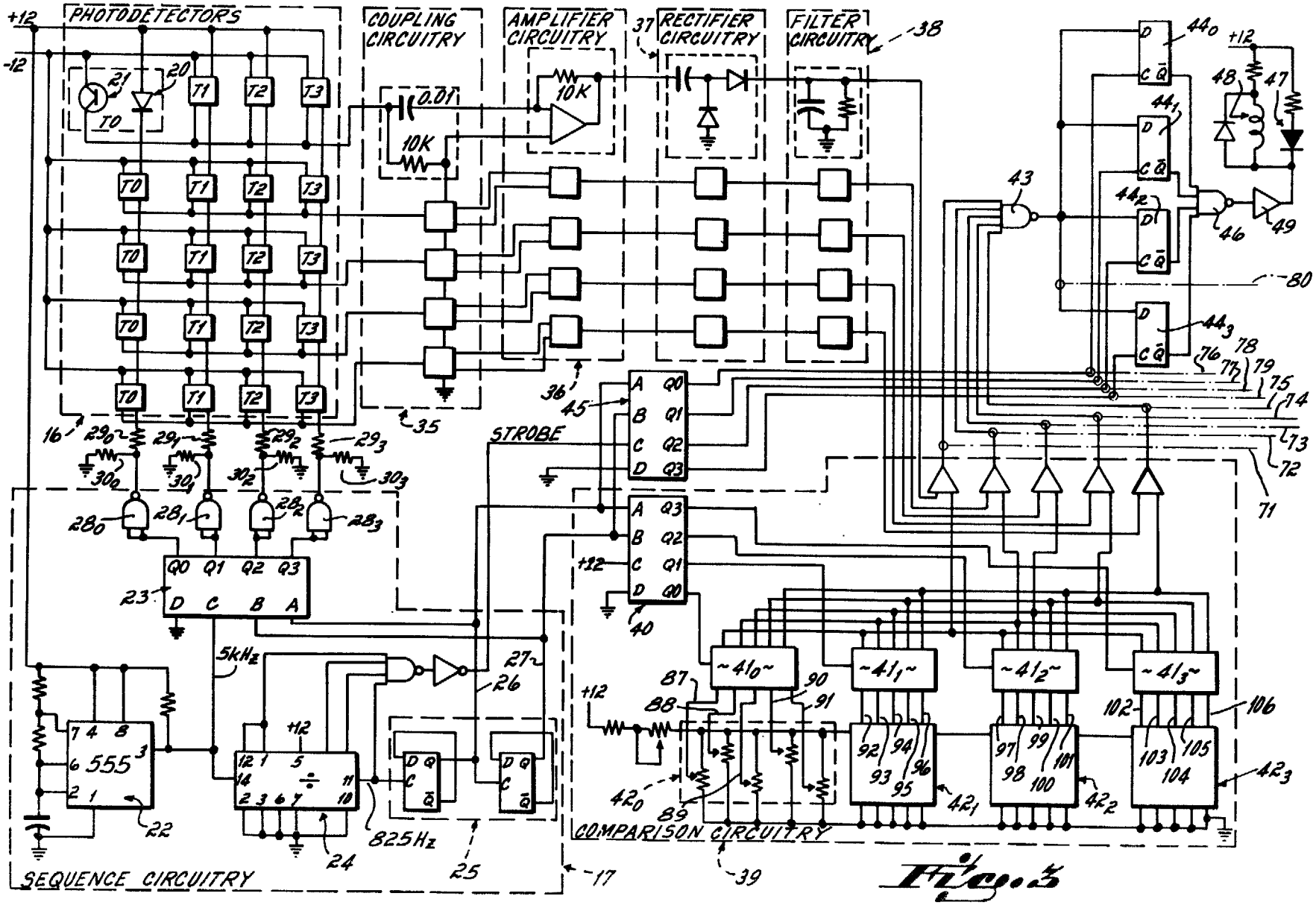
FIG. 3 is a schematic diagram of a preferred embodiment of the apparatus of the present invention.

FIG. 3 shows the photodetectors 16 and other circuitry. The other circuitry includes means for controlling power to the photodetectors, for determining whether or not light reflected from the end portions 11 of cigarettes in the group 10 indicates properly filled cigarettes for activating an indicator to display whether or not there are missing or improperly filled cigarettes and for energizing an ejecting device in the event of a defective group 10.

As shown in FIG. 3, each photodetector includes a light-emitting source 20, such as an infrared light-emitting diode, and a photoelectric transducer 21, such as a phototransistor. The photoelectric transducer 21 is optically shielded from the associated light-emitting source 20 so that only light emanating from the light-emitting source which is reflected from the registered end portion 11 of a cigarette impinges on the photoelectric transducer.

In order to minimize optical coupling between photodetectors 16, the present invention provides sequence circuitry 17 for controlling the power to the light-emitting sources 20 so that no two adjacent sources are modulated simultaneously. In the preferred embodiment, each light-emitting source 20 is modulated in one of four time intervals during the period of inspecting the cigarettes in the group 10. Four time intervals have been selected as the optimum number for providing sufficient optical isolation while at the same time minimizing the cost of construction using readily available electronic components. It is contemplated within the scope of the present invention, however, that any number of time intervals can be selected for modulating the light-emitting sources 20 so that no two adjacent sources are modulated simultaneously. For example, each of the twenty light-emitting sources 20 could be modulated during a separate time interval. The only contemplated constraint to the number of time intervals is that inspection should be completed during the momentary pause of the carrier 12 so as not to slow down the speed of production of the cigarette making or packaging machinery.

As shown in FIG. 2, the photodetectors 16 are modulated during indicated ones of the four time intervals. Thus, each photodetector in rows $13_1$–$13_3$ and columns $14_1$–$14_{13}$ is labeled with a timer interval T0, T1, T2 or T3 during which the light-emitting source is modulated. As can be seen, no two adjacent photodetectors are modulated during the same time interval.

Referring again to FIG. 3, the circuitry for sequentially modulating the light-emitting sources 20 in accordance with the convention indicated in FIG. 2 is provided by the sequence circuitry 17. The sequence circuitry 17 includes a 555 timer circuit 22 which produces clock pulses at a high frequency of five kHz, for example. The five kHz pulses are applied to the clock input of a 74C42 decoder 23 and to the input of a frequency divider 24 which produces incrementing pulses at a frequency of approximately 825 Hz, for example. The 825 Hz incrementing pulses are applied to the input of a two-stage binary counter 25. The output of the first counter stage is connected by a line 26 to the A input of the decoder 23, and the output of the second counter stage is connected by the line 27 to the B input of the decoder 23.

The begining of the first time interval T0 coincides with the start of inspection. During the first time interval, a logic zero state appears at the output of both stages of the counter 25. The decoder 23 decodes the count and consequently produces five kHz pulses at its Q0 output in response to the clock pulses from the timer circuit 22.

The Q0 output of the decoder 23 is connected to the input of a 74C906 high-current switch, or NAND gate, $28_0$. The five kHz pulses at the Q0 output of the decoder 23 cause the output of the NAND gate $28_0$ to transpose between logic zero and logic one states at a frequency of five kHz.

AS shown in FIG. 3, the light-emitting sources 20 of the photodetectors designated T0 are connected in series between a power supply and a series including a current-limiting resistor $29_0$ and a biasing resistor $30_0$ connected to common. The junction between the current-limiting resistor $29_0$ and the biasing resistor $30_0$ is connected to the output of the NAND gate $28_0$.

Whenever the output of the NAND gate $28_0$ transposes a logic zero state during the first time interval t0, the biasing resistor $30_0$ is effectively short-circuited. Consequently, the current flowing through the light-emitting sources increases. As a result, the light-emitting sources 20 of the photodetectors designated T0 glow more brightly. On the other hand, whenever a logic one state appears at the output of the NAND gate $28_0$ during the first time interval T0, the light-emitting sources dim. The end result is that the circuitry 22–30 causes modulation of the current flowing through the light-emitting sources 20 resulting in modulation of the intensity of the light emanating from the light-emitting sources.

As can be seen from FIGS. 2 and 3, five kHz pulses at the Q0 output of the decoder 23 result in simultaneous modulation of the five light-emitting sources 20 of the photodetectors designated T0 during the first time interval T0. However, as shown in FIG. 2, no two adjacent light-emitting sources are modulated during the first time interval. As a result, optical coupling between photodetectors is minimized.

At the start of the second time interval T1, the output of frequency divider 24 increments the counter 25. Consequently, the first counter stage transposes to a logic one state which is applied to the A input of the decoder 23. A logic zero state from the second counter stage remains at the B input of the decoder 23. Consequently, the decoder 23 discontinues applying five kHz pulses to the NAND gate $28_0$ and instead applies five kHz pulses to the input of the NAND gate $28_1$ connected to the Q1 output of the decoder 23. This results in modulation of the light-emitting sources 20 of the photodetectors designated T1 during the second time interval in the manner already described for the ones designated T0 during the first time interval.

At the start of the third time interval T2, frequency divider 24 again increments the counter 25. Consequently, a logic zero state appears on the line 26 and a logic one state appears on the line 27. As a result, the decoder 23 produces five kHz pulses at its Q2 output. This results in modulation of the light-emitting sources 20 of the photodetectors designated T2.

Finally, at the start of the fourth time interval T3, the frequency divider 24 increments the counter 25 to produce a logic one state on both lines 26 and 27. The decoder 23 decodes the signals on lines 26 and 27 and, consequently, produces five kHz pulses at its Q3 output. This results in modulation of the light-emitting sources 20 of the photodetectors designated T3.

The end result is that the light-emitting sources of the photodetectors labeled T0 in FIG. 2 are modulated in the first time interval, the light-emitting sources of the photodetectors labeled T1 are modulated in the second time interval, the light-emitting sources of the photodetectors labeled T2 are modulated in the third time interval, and the light-emitting sources of the photodetectors labeled T3 are modulated in the fourth time interval. Consequently, during each time interval, modulated light is reflected off the end portions 11 of cigarettes in the group 10 which are in registration with the modulated light-emitting sources. The reflected modulated light is in turn sensed by the associated photoelectric transducers 21 of the photodetectors.

The gain curve for the phototransistors used as the photoelectric transducers 21, unlike the gain curve for photodiodes, is not linear. That is, doubling the intensity of incident light, for instance, does not necessarily double the emitter-collector current, but results in more than doubled current. This is especially apparent at very low light intensities and becomes less and less apparent as the light intensity increases. The result is that there might be an apparent change in sensitivity of the photoelectric transducers to the modulated light depending on the intensity of ambient light. However, the biasing resistors 30 are preferably included for providing a biasing signal for the light-emitting sources so that the effect of ambient light is swamped out and apparent changes in sensitivity of the photoelectric transducers 21 due to varying amounts of ambient light are minimized. If, on the other hand, photodiodes or other linear components were substituted for the phototransistors, the biasing resistors 30 could be eliminated.

As can be seen in FIG. 3, the signals produced by the photoelectric transducers 21 are connected through coupling circuitry 35 to amplifier circuitry 36. The coupling circuitry includes AC-coupling circuits which pass only the high frequency components of the photoelectric transducer signals. Consequently, only signals produced by the photoelectric transducers 21 in response to the modulated light from the light-emitting sources 20 reach the amplifier circuitry 36. As a result, the effects of varying ambient light are substantially eliminated since the component of the signals produced by the photoelectric transducers due to ambient light is of a relatively low frequency and is not coupled to the amplifier circuitry 36.

As shown in FIG. 3, the outputs of a plurality of photoelectric transducers 21 are connected in common through one AC-coupling circuit to one input of an amplifier in the amplifier circuitry 36. As described above, however, the sequence circuitry 17 causes only one of the light-emitting sources associated with the commonly connected photoelectric transducers to be modulated during a given time interval. Consequently, only the photoelectric transducer associated with the modulated light-emitting source produces a signal at the input of an amplifier during a given time interval.

The signals at the output of the amplifier circuitry 36 are rectified by the rectifier circuitry 37 and then smoothed by filter circuitry 38 for providing DC signals at the input of comparison circuitry 39. Only the signals produced by the commonly connected photoelectric transducers which sense reflected modulated light produce signals which are amplified, rectified and filtered and then appear at the inputs of the differential comparators in the comparison circuitry 39.

In the embodiment shown in the drawing, for inspecting each group of twenty cigarettes, wherein four time intervals are employed to minimize optical coupling, four photoelectric transducers are connected in common through the coupling circuitry 35 to the amplifier circuitry 36 and then through the rectifier circuitry 37 and the filter circuitry 38 to the comparison circuitry 39. As a result, only five coupling circuits, five amplifiers, five rectifier circuits and five filter circuits are required.

Threshold signals are applied to the other inputs of the differential comparators in the comparison circuitry 39. As shown in FIG. 3, threshold adjusting circuitry is provided for presetting the threshold signal that each of the amplified, rectified and filtered photoelectric transducer signals must equal or exceed to indicate the presence of a properly filled cigarette in registration with the photodetector. The threshold adjusting circuitry includes a 74C42 decoder 40 whose A and B inputs are connected in parallel with the A and B inputs of the decoder 23. The decoder 40 decodes the count in the counter 25 to sequentially produce a logic one state at its Q0, Q1, Q2 and Q3 outputs during the same time that the five kHz pulses appear at the corresponding Q0, Q1, Q2 and Q3 outputs of the decoder 23 during the respective first, second, third and fourth time intervals.

The Q0 output of the decoder 40 enables a CD4066 gate circuit $\mathbf{41}_0$ during the first time interval T0. This results in connection of the other differential comparator inputs through respective gates of the gate circuit $\mathbf{41}_0$ and a voltage divider circuit $\mathbf{42}_0$ to a power supply. The voltage divider circuit $\mathbf{42}_0$ sets the threshold signals for comparison with each amplified, rectified and filtered photoelectric transducer signal. As shown in FIG. 3, the voltage divider circuit $\mathbf{42}_0$ includes a plurality of adjustable potentiometers for separately presetting the threshold signal that each amplified, rectified and filtered signal originating at the photoelectric transducers designated T0 must equal or exceed in order to indicate the presence of properly filled cigarettes.

In a similar manner, the Q1 output of the decoder 40 transposes to a logic one state during the second time interval T1. Consequently, a CD4066 gate circuit $\mathbf{41}_1$ is enabled, and the other inputs of the differential comparators are connected through respective gates of the gate circuit $\mathbf{41}_1$ and a voltage divider circuit $\mathbf{42}_1$ to the power supply so as to establish the threshold signals that the amplified, rectified and filtered signals originating at the photoelectric transducers designated T1 must equal or exceed in order to indicate that properly filled cigarettes are present.

Similarly, logic one states appear sequentially at the Q2 and Q3 outputs of the decoder 40 during the third and fourth time intervals T2 and T3 for enabling the respective CD4066 gate circuits $\mathbf{41}_2$ and $\mathbf{41}_3$ so as to establish the threshold signals with which the amplified, rectified and filtered signals originating at the photoelectric transducers designated T2 and T3 are compared during the third and fourth time intervals.

If an amplified, rectified and filtered photoelectric transducer signal is less than the threshold signal established for that particular photodetector, the corresponding differential comparator in the comparison circuitry 39 produces a reject signal in the form of a logic zero state. The presence of a reject signal at the output of one of the differential comparators indicates that insufficient light has been reflected from the end portion 11 of a cigarette in the group 10 because either a cigarette is missing or the end portion 11 of the cigarette is not properly filled. On the other hand, if the signal originating at the photoelectric transducer 21 indicates that a properly filled cigarette is present, a logic one state appears at the output of the differential comparator.

The signals produced by the differential comparators in comparison circuitry 39 can be supplied to utilization circuitry for any one of a number of control purposes. That is, the reject signal may be used for energizing a solenoid to eject a defective group 10 of cigarettes or for displaying that cigarettes are missing or improperly filled. The individual signals produced by the differential comparators within the time intervals can also be used for driving a display to indicate the positions of missing or improperly filled cigarettes.

A circuit for energizing a solenoid to reject a defective group 10 of cigarettes and for indicating whether or not a group of cigarettes passes inspection is disclosed in FIG. 3. In the embodiment shown in FIG. 3, the output of each differential comparator in the comparison circuitry 39 is connected to one input of a NAND gate 43. The output of the NAND gate 43 is in turn connected to the D input of each D flip-flop $44_0$, $44_1$, $44_2$ and $44_3$.

The clock input of the D flip-flops $44_0$–$44_3$ are respectively connected at the Q0, Q1, Q2 and Q3 outputs of a 74C42 decoder 45. The A and B inputs of the decoder 45 are connected in parallel with the A and B inputs of the decoders 23 and 40 to the counter 25. The clock input of the decoder 45 is connected to a STROBE line.

In operation, the sequence circuitry 17 produces a strobe pulse on the STROBE line at the end of each of the four time intervals T0–T3. At the end of the first time interval, the decoder 45 produces a logic one state at its Q0 output in response to the strobe pulse, and, similarly, the decoder 45 produces a logic one state at its Q1, Q2 and Q3 outputs in response to strobe pulses which occur at the end of the second, third and fourth time intervals, respectively. Consequently, a logic one state appears at the clock input of the D flip-flop $44_0$ at the end of the first time interval, and logic one states appear at the clock inputs of the D flip-flops $44_1$, $44_2$ and $44_3$ at the end of the second, third and fourth time intervals, respectively, for sequentially clocking out the complement of the logic state stored in the D inputs to the $\overline{Q}$ outputs of the D flip-flops $44_0$–$44_3$.

As explained above, if a missing or improperly filled cigarette is detected, the differential comparator receiving a signal originating at a photoelectric transducer in registration with a missing or improperly filled cigarette produces a reject signal in the form of a logic zero state at the output of the differential comparator. If a reject signal appears at the output of any one of the differential comparators, the output of the NAND gate 43 transposes to a logic one state which appears at the D input of the D flip-flops $44_0$–$44_3$. Therefore, when a strobe pulse causes the decoder 45 to produce a logic one state at the clock input of one of the D flip-flops at the end of the time interval as determined by the decoder 45, a logic zero state appears at the $\overline{Q}$ output of the D flip-flop.

As shown in FIG. 3, the $\overline{Q}$ output of each D flip-flop $44_0$–$44_3$ is connected to an input of a NAND gate 46. If a missing or improperly filled cigarette is detected, the $\overline{Q}$ output of a D flip-flop transposes from a logic one state to a logic zero state which in turn causes the output of the NAND gate 46 to assume a logic one state. As a result, a solenoid 48 is energized by the output of an amplifier 49 whose input is connected to the NAND gate 46. This solenoid may be employed to eject the cigarettes from the carrier 12. However, a logic one state normally appears at the $\overline{Q}$ output of each D flip-flop. Consequently, the output of the NAND gate 46 normally assumes a logic zero state such that current flows through the LED indicator 47 to indicate that the group 10 of cigarettes passes inspection.

Figure 4:
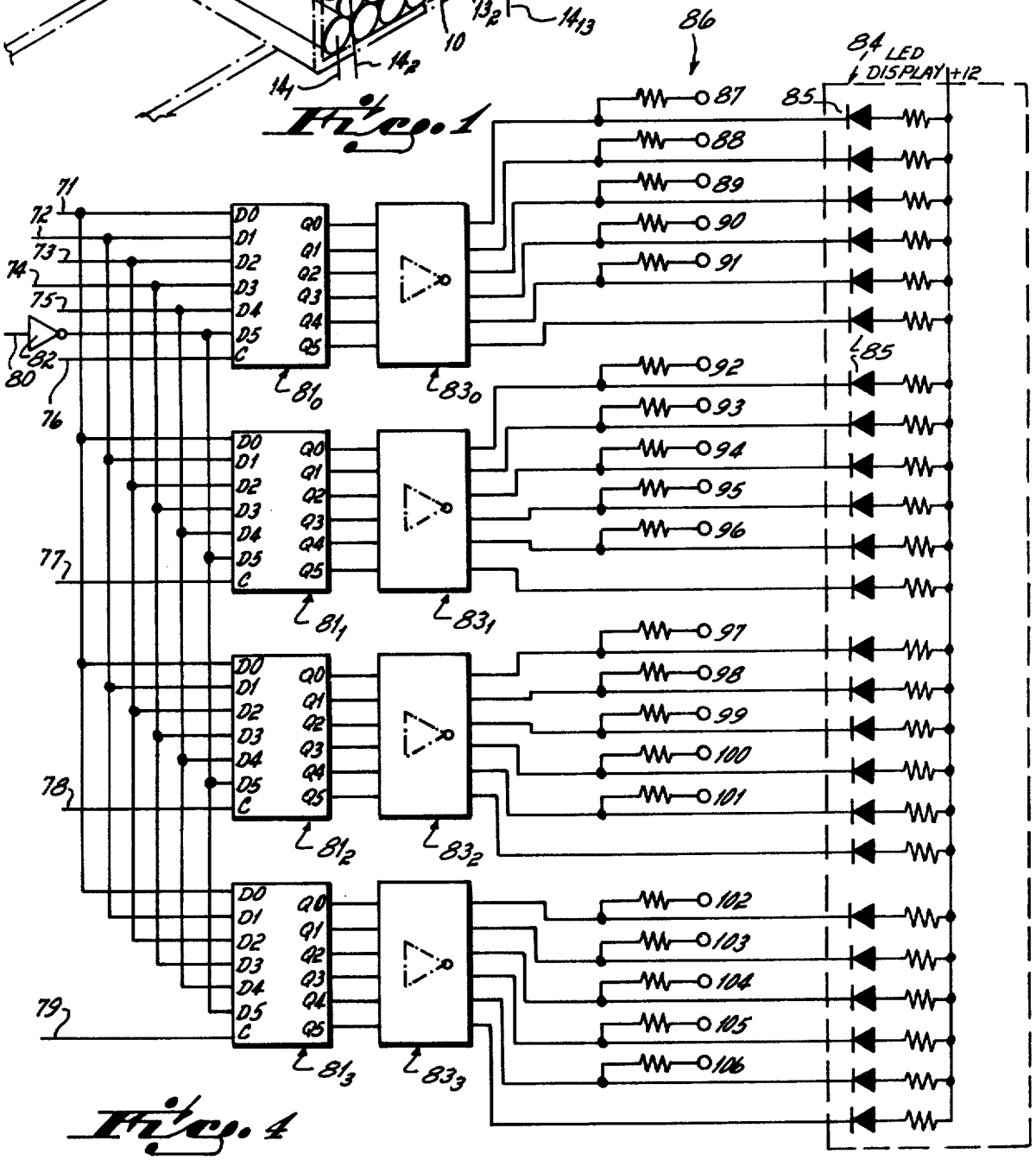
FIG. 4 illustrates a modification of the circuit shown in FIG. 3.

The embodiment in FIG. 3 can be modified in accordance with the circuit shown in FIG. 4 for indicating the individual positions of missing and improperly filled cigarettes. In the modification shown in FIG. 4, the D flip-flops $44_0$–$44_3$, the NAND gate 46, the LED indicator 47, the solenoid 48 and the amplifier 49 are eliminated, and the lines labeled 71–80 in FIG. 3 are connected to the corresponding lines 71–80 in FIG. 4.

In FIG. 4, D registers $81_0$, $81_1$, $81_2$ and $81_3$ each have D0, D1, D2, D3 and D4 inputs connected to the respective lines 71–75. The lines 71–75 are in turn connected to the outputs of the differential comparators in the comparison circuitry 39 in FIG. 3. Preferably, as shown in FIG. 3, the outputs of the differential comparators remain connected to the NAND gate 43, and the output of the NAND gate 43 is connected by the line 80 through an inverter 82 to the D5 input of each D register $81_0$–$81_3$. Finally, the Q0, Q1, Q2 and Q3 outputs of the decoder 45 are connected to the respective clock inputs of the D registers $81_0$–$81_3$ by the lines 76–79.

In operation, strobe pulses at the clock input of the decoder 45 in FIG. 3 cause a logic one state to appear sequentially on the lines 76–79 at the end of the respective time intervals T0–T3. Consequently, a logic one state is sequentially applied to the clock input of each D register $81_0$–$81_3$ for clocking out the logic states stored in the D inputs to the Q outputs of the D registers. As a result, each of the Q0–Q4 outputs of each D register $81_0$–$81_3$ transposes to a logic one state if a properly filled cigarette is detected or to a logic zero state if a cigarette is missing or improperly filled. Also, the Q5 output of each D register $81_0$–$81_3$ will assume a logic one state if all cigarettes registered with the modulated light-emitting sources during a given time interval are properly filled and will assume a logic zero state if a missing or improperly filled cigarette is detected.

Each of the Q0–Q4 outputs of each D register $81_0$–$81_3$ may be connected to an input of a NAND gate (not shown) whose output may be utilized to control an eject solenoid or light a display to indicate that the group 10 of cigarettes has passed inspection similar to the embodiment in FIG. 3. However, as shown in FIG. 4, the Q0–Q5 outputs of the D registers $81_0$–$81_3$ are preferably connected to CD4049 buffer amplifiers $83_0$–$83_3$ for driving an LED display 84.

As can be seen by reference to FIG. 4, the LED display 84 will indicate the position of a missing or improperly filled cigarette in the group 10 by extinguishing a particular LED 85. The LED display 84 also facilitates presetting the threshold signal for each photodetector by, first, registering a properly filled cigarette with the photodetector and, second, adjusting the threshold signal to a set point just below the value at which the associated LED 85 is extinguished.

Furthermore, as shown in FIG. 4, the buffer amplifiers $83_0$ –$83_3$ are individually connected through feedback resistors 86 to terminals 87–106 in the voltage divider circuits $42_0$–$42_3$. The feedback provides hysteresis by changing the threshold downwardly when the signal originating at a photoelectric transducer indicates that a properly filled cigarette is present. As a result, the signal from the photoelectric transducer must decrease to a point somewhat below the original threshold signal in order to change the state of the differential comparator output.

The apparatus of the present invention is preferably implemented by means of readily available electronic circuit components which are identified in the description. The components are relatively inexpensive. The use of electronic circuitry has the advantage that the apparatus of the present invention is extremely reliable in operation and virtually maintenance-free so as to minimize downtime on the cigarette making and packaging production line.

The minimizing of optical coupling and of effects due to varying ambient light results in a device for inspecting a group of cigarettes which provides extremely accurate inspection and may be universally applied in cigarette making and packaging facilities having different environments. The apparatus can be easily installed and the threshold signals can be readily adjusted for any plant conditions.

The present invention has been described in connection with a preferred embodiment and several modifications have been considered. Other modifications than those described may be recognized by those of skill in the field without departing from the spirit and scope of the present invention. Therefore, in order to ascertain the scope of the invention, reference must be had to the appended claims.

We claim:

1. An optoelectronic apparatus for detecting when a cigarette is missing from a preformed group of cigarettes and when a cigarette in said group is improperly filled, said group normally having a predetermined number of cigarettes arranged in columns and rows, said group being conveyed to a position proximate said apparatus, said apparatus comprising:

a plurality of photodetectors equal in number to said predetermined number, said photodetectors being arranged in columns and rows corresponding to said columns and rows of cigarettes in said group such that there is a one-to-one correspondence between a photodetector and each cigarette in said group;

each said photodetector including a light-emitting source for illuminating the end portion of a cigarette registered with said photodetector when power is applied thereto and a photoelectric transducer for producing a signal in response to light reflected from the end portion of said registered cigarette;

sequence circuitry for modulating power to said light-emitting sources at a high frequency such that light emanating from each said light-emitting source alternately increases and decreases in intensity;

AC-coupling circuitry for passing only the high frequency components of each said photoelectric transducer signal; and comparison circuitry responsive to said high frequency components of each said photoelectric transducer signal and to a preselected threshold signal for producing a reject signal when said high frequency components of at least one said photoelectric transducer signal are less than said preselected threshold signal;

whereby the effects of varying ambient light on the accuracy with which missing and improperly filled cigarettes are detected is minimized.

2. The apparatus of claim 1 wherein said sequence circuitry sequentially controls power to said light-emitting sources to that power is applied to no two adjacent ones of said light-emitting sources simultaneously, whereby optical coupling between said photodetectors is minimized.

3. The apparatus of claim 1 or 2 wherein said photoelectric transducers are phototransistors and further including biasing means for providing a biasing signal for said phototransistors so that said phototransistors operate in a linear range when said light-emitting sources are modulated, said biasing signal minimizing apparent changes in sensitivity of said phototransistors due to varying ambient light.

4. The apparatus of claim 1 further including display means for indicating that properly filled cigarettes are present when said reject signal is absent and for indicating that at least one cigarette is missing or improperly filled when said reject signal is present.

5. The apparatus of claim 1 or 4 further including a solenoid responsive to said reject signal for ejecting a group having at least one missing or improperly filled cigarette.

6. The apparatus of claim 1 wherein said comparison circuitry includes threshold adjusting circuitry for separately presetting a threshold signal that each said photoelectric transducer signal must equal or exceed in order for said comparison circuitry not to produce said reject signal.

7. The apparatus of claim 1 or 6 further including means for feeding back a signal to said comparison circuitry in the absence of a reject signal for decreasing said threshold signal that each said photoelectric transducer signal must equal or exceed.

8. An optoelectronic apparatus for detecting when a cigarette is missing from a preformed group of cigarettes and when a cigarette in said group is improperly filled, said group normally having a predetermined number of cigarettes arranged in columns and rows, said group being conveyed to a position proximate said apparatus, said apparatus comprising:

a plurality of photodetectors equal in number to said predetermined number, said photodetectors being arranged in columns and rows corresponding to said columns and rows of cigarettes in said group such that there is a one-to-one correspondence between a photodetector and each cigarette in said group;

each said photodetector including a light-emitting source for illuminating the end portion of a cigarette registered with said photodetector when power is applied thereto and a photoelectric transducer for producing a signal in response to light reflected from the end portion of said registered cigarette;

sequence circuitry connected to said light-emitting sources for controlling power to said light-emitting sources, said sequence circuitry modulating the power applied to said light-emitting sources at a high frequency so that the intensity of said light-emitting sources alternately increases and decreases producing modulated light;

AC-coupling circuitry connected to said photoelectric transducers for passing only high frequency components of said photoelectric transducer signals resulting from modulated light reflected from said end portions;

amplifier circuitry connected to said AC-coupling circuitry for amplifying said high frequency components of said photoelectric transducer signals passed by said AC-coupling circuitry;

rectifier circuitry connected to said amplifier circuitry for converting said high frequency components passed by said AC-coupling circuitry and amplified by said amplifier circuitry to a DC signal;

filter circuitry connected to said rectifier circuitry for smoothing said DC signal;

threshold adjusting circuitry for presetting a threshold signal that each said DC signal must equal or exceed to indicate the presence of a properly filled cigarette; and comparison circuitry connected to said filter circuitry and to said threshold adjusting circuitry for producing a reject signal when at least one said smoothed DC signal is less than said threshold signal.

9. The apparatus of claim 8 wherein said sequence circuitry sequentially controls power to said light-emitting sources so that no two adjacent ones of said light-emitting sources are modulated simultaneously, whereby optical coupling between said photodetectors is minimized.

10. The apparatus of claim 8 or 9 wherein said photoelectric transducers are phototransistors and further including biasing resistors connected to said light-emitting sources for providing a biasing signal for said phototransistors so that said phototransistors operate in a linear range when said light-emitting sources are modulated, said biasing signal minimizing apparent changes in sensitivity of said phototransistors due to varying ambient light.

11. The apparatus of claim 8 further including display means connected to said comparison circuitry for indicating that properly filled cigarettes are present when said reject signal is absent and for indicating that at least one cigarette is missing or improperly filled when said reject signal is present.

12. The apparatus of claim 8 or 11 further including a solenoid connected to said comparison circuitry for ejecting a group having at least one missing or improperly filled cigarette.

13. The apparatus of claim 8 wherein said threshold adjusting circuitry includes voltage divider circuitry having a plurality of potentiometers, each said potentiometer for separately presetting a threshold signal that each said photoelectric transducer signal must equal or exceed in order for said comparison circuitry not to produce said reject signal.

14. The apparatus of claim 8 or 13 further including feedback resistors connected to said threshold adjusting circuitry for feeding back a signal in the absence of a reject signal for decreasing said threshold signal that each said photoelectric transducer signal must equal or exceed.

15. A method for detecting when a cigarette is missing from a preformed group of cigarettes and when a cigarette in the group is improperly filled, the group normally having a predetermined number of cigarettes arranged in columns and rows, including the steps of:

conveying the group to a position proximate a plurality of photodetectors equal in number to the predetermined number, the photodetectors being arranged in columns and rows corresponding to the columns and rows of cigarettes in the group such that there is a one-to-one correspondence between a photodetector and each cigarette in the group, each photodetector including a light-emitting source for illuminating the end portion of a cigarette registered with the photodetector when power is applied thereto and a photoelectric transducer for producing a signal in response to light reflected from the end portion of the registered cigarette;

modulating power to the light-emitting sources at a high frequency such that light emanating from each light-emitting source alternately increases and decreases in intensity as the end portion of each cigarette in the group is illuminated;

comparing the high frequency components of each photoelectric transducer signal with a preselected threshold signal; and producing a reject signal when the high frequency components of at least one photoelectric transducer signal are less than the preselected threshold signal;

thereby minimizing the effects of varying ambient light on the accuracy with which missing and improperly filled cigarettes are detected.

16. The method of claim 15 wherein power to the light-emitting sources is sequentially controlled so that power is applied to no two adjacent light-emitting sources simultaneously, thereby minimizing optical coupling between photodetectors.

17. The method of claim 15 or 16 further including the step of providing a biasing signal for the light-emitting sources so that the photoelectric transducers operate in a linear range where the light-emitting sources are modulated, thereby minimizing apparent changes in sensitivity of the photoelectric transducers due to varying ambient light.

18. The method of claim 15 further including the steps of indicating that properly filled cigarettes are present when the reject signal is absent and indicating that at least one cigarette is missing or improperly filled when the reject signal is present.

19. The method of claim 15 or 18 further including the step of ejecting a group having at least one missing or improperly filled cigarette in response to the reject signal.

20. The method of claim 15 further including the step of separately presetting a threshold signal that each photoelectric transducer signal must equal or exceed in order not to produce the reject signal.

21. The method of claim 15 or 20 further including the step of feeding back a signal in the absence of a reject signal for decreasing the threshold signal that each photoelectric transducer signal must equal or exceed.

* * * * *